United States Patent [19]

Hammacher

[11] Patent Number: 4,481,668

[45] Date of Patent: Nov. 6, 1984

[54] SHOPPING BAG HANDLE AND METHOD OF MANUFACTURE THEREOF

[75] Inventor: Paul D. Hammacher, Stamford, Conn.

[73] Assignee: Champion International Corporation, Stamford, Conn.

[21] Appl. No.: 492,338

[22] Filed: May 6, 1983

[51] Int. Cl.[3] ..... B65D 33/07

[52] U.S. Cl. ..... 383/7; 383/6; 383/10; 383/17

[58] Field of Search ..... 383/7, 10, 17, 27, 6, 383/29

[56] References Cited

U.S. PATENT DOCUMENTS 1,944,151 1/1934 Butterfield et al. ..... 383/7 X
2,924,374 2/1960 Vineberg ..... 383/10

FOREIGN PATENT DOCUMENTS 416296 1/1967 Switzerland ..... 383/8

*Primary Examiner*—Steven M. Pollard
*Attorney, Agent, or Firm*—Evelyn M. Sommer

[57] ABSTRACT

A shopping bag handle is either integral with opposing panels of a grocery bag or is formed in separate inserts attachable to grocery bag panels. The panels have central end regions which have parallel integral reinforced strips extending along the length of the panels and which may be formed by glued pleats in the panels. A U-shaped flap is cut between the reinforced lateral strips. The flap is wrapped and glued around a transverse web at the end of the panel and which is defined by the U-shaped flap. The transverse web is further reinforced by doubling the web thickness and folding its corners inwardly before wrapping the flap around the web. The reinforced web serves as the handle. The base of the handle opening formed by the flap may be formed of a panel which is folded downwardly to cover the cut edge of the transverse portion of the slit forming the flap.

18 Claims, 10 Drawing Figures

SHOPPING BAG HANDLE AND METHOD OF MANUFACTURE THEREOF

BACKGROUND OF THE INVENTION

This invention relates to shopping bag handles and to a method for manufacturing such handles.

It is known to form a handle integrally with a shopping bag or to form the handle in an insert which can be attached to a conventional paper grocery shopping bag.

A one-piece handle formed in a grocery bag is shown in the patent to Finke U.S. Pat. No. 3,409,209. In Finke U.S. Pat. No. 3,409,209, during the forming of the handle, there are lateral handle portions which have a double-bag thickness. Thus, the handle strength is low and the bag can tear easily if carried by the handle with more than nominal weight in the bag.

The patent to Johnson U.S. Pat. No. 1,415,450 shows a paper bag with an integral handle where the handle is formed by a series of cutting, folding and pasting steps, but the resulting handle is relatively weak and does not employ any reinforcement in the handle extension.

The patent to Ishii U.S. Pat. No. 4,062,392 discloses a handle for a shopping bag which employs reinforcing strips where, however, the strips are separate elements which are glued to the bag and are not integral therewith.

BRIEF DESCRIPTION OF THE INVENTION

In accordance with the present invention, a novel handle, and process for its manufacture, is formed for a grocery bag which is either integral with the bag or is attachable thereto. The handle includes two parallel spaced reinforcing strips which are formed integrally with the bag or with the insert and which have a thickness of at least three bag plies. The reinforcing strip may be formed by pleating or gusseting the front and rear bag panels (or inserts therefor) and then gluing the pleated sections together during the bag-forming or insert-forming process. Thereafter, a U-shaped slit is formed between the reinforcing strips to define a tree flap which can be folded and glued around a web from which the longitudinal slit sides extend.

A top flap portion of the web is first turned down so form a reinforcement thickness for the transverse web section of the handle. The web corners are also turned inwardly to reinforce the ends of the web. The flap is thereafter wrapped and glued around this transverse web section.

The longitudinal side slits forming the flap extend for a distance greater than the distance of the transverse slit portion to define a second tab or flap at the base of the handle slot. This tab is folded downwardly and glued in order to eliminate the raw-cut edge which would otherwise appear at the bottom of the handle opening.

DETAILED DESCRIPTION OF THE DRAWINGS

Figure 1:
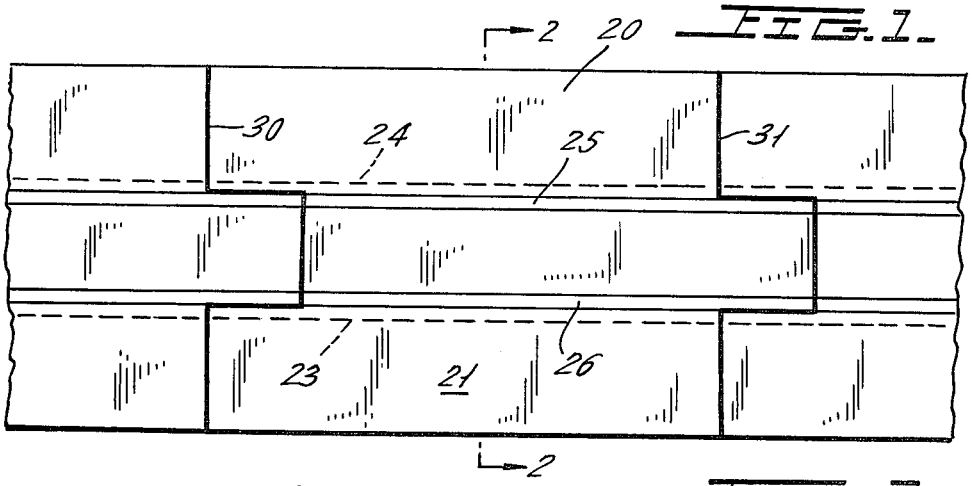
FIG. 1 is a plan view of a longitudinal paper tube from which a series of bags may be formed.
Figure 2:
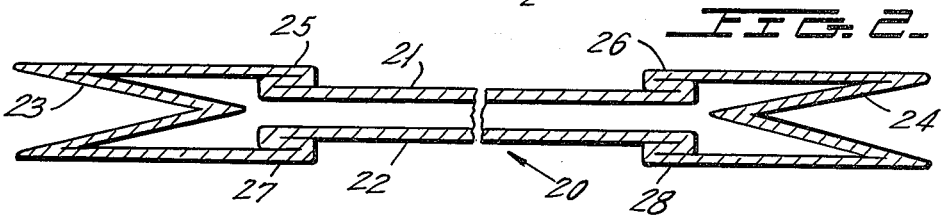
FIG. 2 is a cross-sectional view of one bag cut from the tube of FIG. 1 taken across the section line 2—2 in FIG. 1.

FIGS. 1 and 2 show a longitudinal tube 20 of Kraft paper which is normally transversely slit to define the panels and sides of grocery bags. For example, tube 20 can consist of No. 55 or 60 paper. Conventionally, the tube is tranversely slit to define bags of any desired height and the bag bottoms are conventionally folded and glued to define their bottoms. The tube 20 also conventionally contains front and rear panels 21 and 22 and gusseted side panels 23 and 24.

In accordance with a first aspect of the invention, the panels 21 and 22, during their formation, are pleated to form enlarged thickness strips 25, 26, 27 and 28. Each of the pleated reinforced strips 25–28 contains three plies but any desired number of plies can be used. The strips are typically about $\frac{1}{2}$ inch wide and could be up to $\frac{3}{4}$ inch wide. They may be spaced from one another by any desired dimension, typically by about 3 inches.

The bag panels are severed from the tube 20 at severance lines 30 and 31 shown in FIG. 1. The severence lines produce an upwardly projecting handle section 32 shown in FIG. 3 with a corresponding notch 33 at its bottom. Note that the handle section 32 and notch 33 are in both the front and rear panels 21 and 22 of the bag. Typically, the height of the handle section 32 can be 4 inches and its width is sufficient to include both of the pleated sections 25 and 26 in panel 21 and 27 and 28 in panel 22 and can extend beyond the edges of these reinforced sections by up to about $\frac{1}{2}$ inch.

Figure 3:
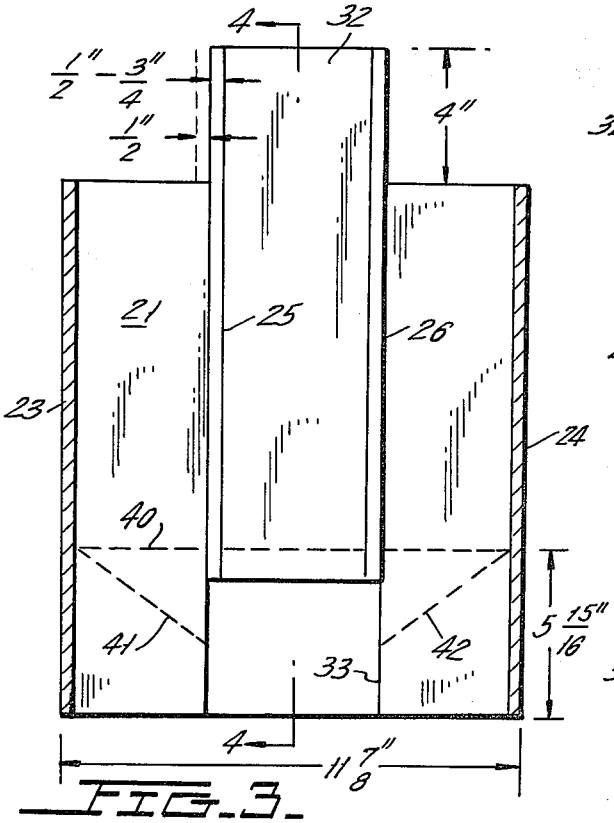
FIG. 3 is a cross-sectional view taken through the gusseted sides of one of the bags which is cut from the stock of FIG. 1.
Figure 4:
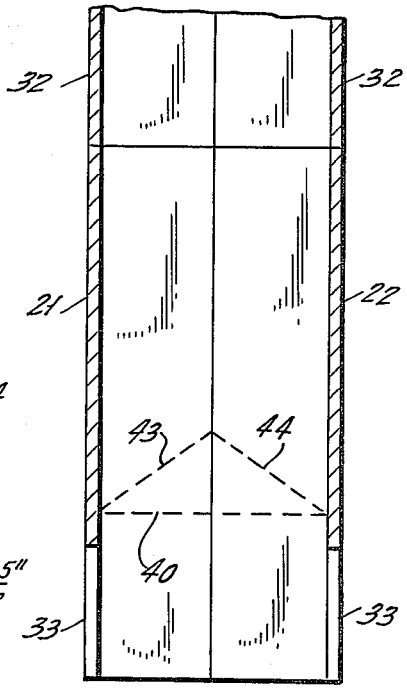
FIG. 4 is a side cross-sectional view of FIG. 3 taken across the section line 4—4 of FIG. 3.

After slitting in the manner shown in FIG. 1 to produce the sections shown in FIGS. 3 and 4, the bottom of the tube can be folded on the dotted fold lines 40 through 44 in FIGS. 3 and 4 with the bottom thereafter conventionally glued to form the bag bottom. The fold line 40 typically can be about 5 15/16 from the bottom of the bag tube. Thus, the presence of the notch 33 does not interfere with forming the bottom of the bag in a conventional manner.

In the following description of FIGS. 5–10, the bag structure described will have a handle formed integrally with the bag panels. It should be noted that the novel invention can be applied to a bag insert which will have the general structure to be described along with the projecting handle section 32 and reinforcing strips 25–28 in a Kraft paper section which can be glued to the interior or exterior of a conventional grocery bag.

FIGS. 5–10 illustrate the steps by which the handle portion 32 of either the integral bag panel of FIGS. 1–4 or of a bag insert is processed to form the novel handle of the invention. Note that, in FIGS. 3 and 4, both the handles 32 in panels 21 and 22 will be identically processed as to be described in FIGS. 5–10. Note further that, where the invention is applied to a bag insert rather than to the bag panel itself, the bag insert will have the reinforced sections 25 and 26 formed therein before further processing takes place.

Figure 5:
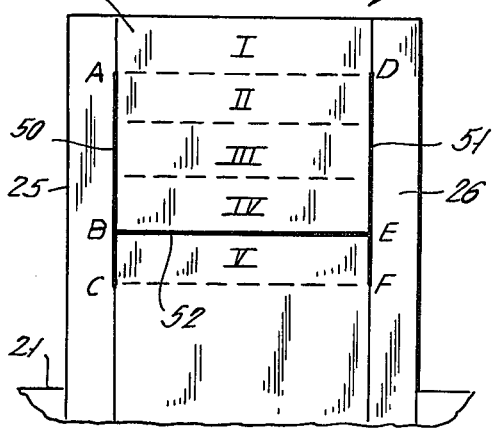
FIG. 5 shows the top handle portion of the panel shown in FIG. 3 after slitting the handle portion.

The first step of the handle producing process is shown in FIG. 5, wherein two longitudinal slits 50 and 51 and a transverse slit 52, which joins slits 50 and 51, are formed in handle 32. Slit 50 extends from point A to point C and may be 2 inches in length. Similarly, slit 51 extends from point D to point F and is coextensive with and parallel to slit 50. Slit 52 extends transversely across the handle section 32 from point B to point E.

Points A and D of slits 50 and 51 are removed from the top of handle 32 by about ½ inch and define a transverse web 55 within the handle 32.

Five panel sections are labeled with Roman numerals I through V in FIG. 5. Each of these panel sections has a height of about ½ inch and a width equal to the width between slits 50 and 51.

Figure 6:
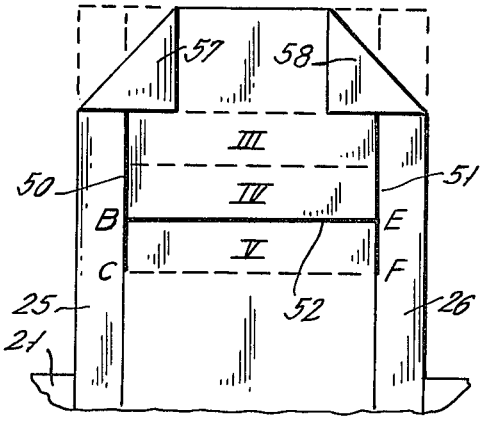
FIG. 6 shows the first step in the process of forming the handle opening in which the corners of the handle portion are folded and glued inwardly.
Figure 7:
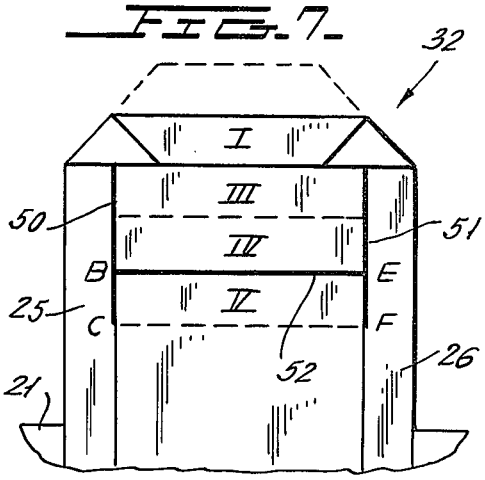
FIG. 7 shows the step following that of FIG. 6 in which the top portion of the handle is folded downwardly to form a reinforced transverse handle section.

In the first step of the process and as shown in FIG. 6, two corner sections 57 and 58 are bent inwardly over the panels I and II and are glued thereto. Thereafter, and as shown in FIG. 7, the upper web section I is bent over atop the panel section II and is glued thereto. This forms a generally reinforced web section consisting of the thicknesses of panels I and II with the reinforcing triangularly bent corners 57 and 58.

Figure 8:
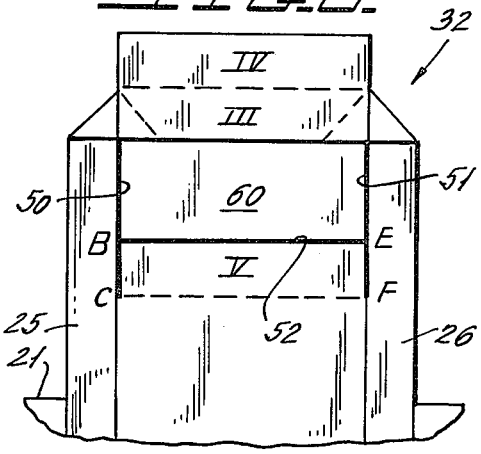
FIG. 8 shows the step following that of FIG. 7 in which the flap formed by slitting is folded upwardly over the transverse section.

Thereafter, the free flap sections III and IV are bent upwardly as shown in FIG. 8 and the panel III is glued to the web panel 1. The upward folding of the flap defines a handle opening 60 in the handle 32.

Figure 9:
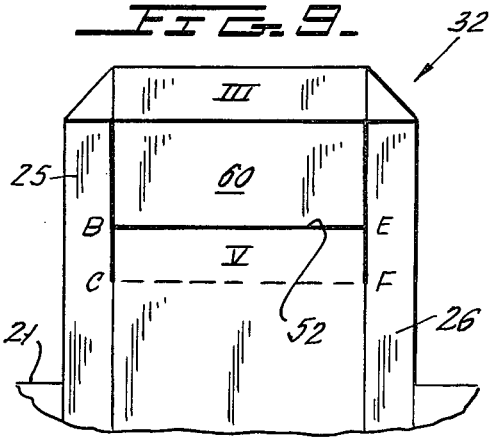
FIG. 9 shows the step following that of FIG. 8 wherein the upper flap portion of the flap is folded down over the transverse handle section.

Thereafter, as shown in FIG. 9, the panel IV of FIG. 8 is bent downwardly and is glued to the rear of panel II. This then completely defines the web portion of the carrying handle which now consists of four thicknesses of the bag body with its edges reinforced by the triangular corners 57 and 58.

Figure 10:
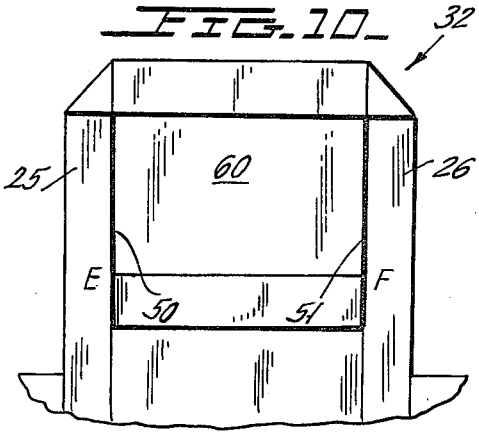
FIG. 10 shows the last step in the formation of the handle in which the bottom flap beneath the transverse portion of the slit is folded downwardly to define a folded edge at the base of the handle opening.

Thereafter, the panel portion V defined by the extending portions of slits 50 and 51 from points B to E and C and F respectively is folded downwardly as shown in FIG. 10. This removes the raw slit edge 52 from the bottom of handle opening 60.

The above procedure is repeated for the handle section in the other bag panel or is repeated for any desired number of bag inserts which can be subsequently glued to the interior of a conventional shopping bag.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. The method of making a handle for a paper shopping bag panel, said method comprising the steps of:

forming first and second increased thickness strips in said panel which are parallel to one another and which are spaced from one another by a given dimension and which extend parallel to the longitudinal direction in which said handle extends;

forming first and second parallel and coextensive longitudinal slits in said panel which are parallel to and extend along respective ones of the facing longitudinal edges of said first and second increased thickness strips; one end of each of said first and second slits beginning at first and second points respectively which are removed from an end of said panel to define a web extending across one end of said panel; the opposite end of each of said first and second slits terminating at third and fourth points which are contained within the bottom of the handle opening to be formed;

forming a third slit in said panel which extends perpendicularly between said first and second slits to define a flap which extends from said web which extends across the top of said panel;

and thereafter wrapping and securing said flap around said web to define an enlarged thickness carrying handle bounded at its sides by said increased thickness strips in said panel with a hand opening defined beneath said web.

2. The method of claim 1, wherein said increased thickness strips are formed by pleating the panel material and securing together the pleats in said panel.

3. The method of claim 2 which includes the step of triangularly folding and securing the corners of the ends of said increased thickness strips over said web before wrapping said flap around said web.

4. The method of claim 1, wherein said panel is one panel of the paper body of a shopping bag and wherein an identical handle is formed in the other and facing panel of said shopping bag.

5. The method of claim 4, wherein said increased thickness strips are formed by pleating the panel material and securing together the pleats in said panel.

6. The method of claim 4, wherein said third and fourth points of said first and second slits terminate below said third slit, thereby to define a second flap at the bottom of the opening formed by said flap; said second flap being folded down and secured to said panel, thereby to cover the edge defined by said third slit.

7. The method of claim 1, wherein said third and fourth points of said first and second slits terminate below said third slit, thereby to define a second flap at the bottom of the opening formed by said flap; said second flap being folded down and secured to said panel, thereby to cover the edge defined by said third slit.

8. The method of claim 7 which includes the step of triangularly folding and securing the corners of the ends of said increased thickness strips over said web before wrapping said flap around said web.

9. The method of claim 7, wherein said increased thickness strips are formed by pleating the panel material and securing together the pleats in said panel.

10. The method of claim 9 which includes the step of triangularly folding and securing the corners of the ends of said increased thickness strips over said web before wrapping said flap around said web.

11. The method of claim 1, wherein said handle is securable to the main panel of a conventional paper shopping bag.

12. The method of claim 11, wherein said increased thickness strips are formed by pleating the panel material and securing together the pleats in said panel.

13. The method of claim 11, wherein said third and fourth points of said first and second slits terminate below said third slit, thereby to define a second flap at the bottom of the opening formed by said flap; said second flap being folded down and secured to said panel, thereby to cover the edge defined by said third slit.

14. The method of claim 1 which includes the step of triangularly folding and securing the corners of the ends of said increased thickness strips-over said web before wrapping said flap around said web.

15. A paper shopping bag handle comprising a paper panel having first and second parallel integral narrow pleated reinforcing strips consisting of at least three plies, which strips extend longitudinally of said bag; a flap cut between said first and second strips; said flap extending from a transverse web extending across the free end of said paper panel and between said strips; said flap being wound around and secured to said web to define a handle opening and a reinforced handle extending between said reinforced strips.

16. The handle of claim 15, wherein said web section comprises at least a double thickness of said paper panel, defined by folding and gluing together elongated integral transverse strips of said panel.

17. The handle of claim 16, wherein the corners of said web section are folded over and secured to the transverse body of said web to reinforce the corners of said web at which it joins said reinforcing strips.

18. The handle of claim 15, wherein the corners of said web section are folded over and secured to the transverse body of said web to reinforce the corners of said web at which it joins said reinforcing strips.

* * * * *